US010512337B2

(12) United States Patent
Leng

(10) Patent No.: US 10,512,337 B2
(45) Date of Patent: Dec. 24, 2019

(54) SOFA BED

(71) Applicant: NEW-TEC INTEGRATION (XIAMEN) CO., LTD., Xiamen, Fujian (CN)

(72) Inventor: Luhao Leng, Fujian (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 216 days.

(21) Appl. No.: 15/660,541

(22) Filed: Jul. 26, 2017

(65) Prior Publication Data

US 2018/0035816 A1 Feb. 8, 2018

(30) Foreign Application Priority Data

Aug. 2, 2016 (CN) ..... 2016 1 0623810

(51) Int. Cl.
*A47C 20/00* (2006.01)
*A47C 17/17* (2006.01)

(52) U.S. Cl.
CPC ..... *A47C 17/17* (2013.01); *A47C 20/00* (2013.01)

(58) Field of Classification Search
CPC ..... A47C 20/20; A47C 20/00
USPC ..... 5/12.1, 13, 37.1
See application file for complete search history.

(56) References Cited

U.S. PATENT DOCUMENTS 4,048,680 A 9/1977 Rogers, Jr.
5,528,778 A 6/1996 Shrock et al.
6,209,154 B1 * 4/2001 Huang ..... A47C 17/162 297/354.13
2016/0213156 A1 7/2016 Angle

OTHER PUBLICATIONS

EP Search Report cited in EP Application No. 17001299.1 dated Jan. 12, 2018 6 pgs.

* cited by examiner

*Primary Examiner* — Frederick C Conley
(74) *Attorney, Agent, or Firm* — Cooper Legal Group, LLC

(57) ABSTRACT

A sofa bed includes a mattress frame, a back frame, two arm frames and two cross beams, two arm frames are connected by the two cross beams, wherein the mattress frame and the back frame are rotatably pivoted. The inner side of the arm frame is disposed with a linking mechanism. The linking mechanism has a front connecting piece, rear connecting piece and a bridge connecting piece. Two ends of the bridge connecting piece are respectively pivoted to the front connecting piece and the rear connecting piece. The bottom end of the front connecting piece is pivoted to the arm frame. The bottom end of the rear connecting piece is pivoted to the arm frame. The linking mechanism has a front connecting piece, rear connecting piece and a bridge connecting piece.

11 Claims, 5 Drawing Sheets

SOFA BED

FIELD OF THE INVENTION

The present invention relates to a new sofa bed.

BACKGROUND OF THE INVENTION

A sofa bed comprises a mattress frame, a back frame and two arm frames, the mattress frame and the back frame are connected to the arm frames by hinge devices. The hinge device comprises a base, a front side connecting piece, a front support plate, a rear side connecting piece, a rear support plate, a bridge connecting piece, a spring and a spring connecting piece; the front support plate and the rear support plate are respectively fixed to the mattress frame and the back frame, the front side connecting piece is disposed between the front support plate and the base, the rear side connecting piece is disposed between the rear support plate and the base, the bridge connecting piece is disposed between the front side connecting piece and the rear side connecting piece. Existing sofa bed has technical problems: firstly, the sofa bed needs large quantity of hinge devices, the structure is complicated, the cost is high, the weight of the sofa bed is also increased. Secondly, the hinge device needs large space, therefore, to increase the container quantity, the hinge devices are packed individually before the sofa bed leaves the factory; consumers need to install the hinge devices to the arms when assembling the sofa bed, and then fix the mattress frame and the back frame respectively to the front support plate and the rear support plate, the assembly is complicated. Thirdly, many bolts are needed to lock between the base and the arm, the front support plate and the mattress frame, the rear support plate and the back frame, the bolt quantity is large, the cost is high, the weight of the sofa bed is increased, the assembly is cumbersome.

SUMMARY OF THE INVENTION

The present invention is provided with a sofa bed with simple structure and convenient installation. The technical proposal of the present invention is that:

A sofa bed, comprising a mattress frame, a back frame, two arm frames and two cross beams, two arm frames are connected by the two cross beams, wherein the mattress frame and the back frame are rotatably pivoted, the inner side of the arm frame is disposed with a linking mechanism, the linking mechanism comprises a front connecting piece, rear connecting piece and a bridge connecting piece, two ends of the bridge connecting piece are respectively pivoted to the front connecting piece and the rear connecting piece, the bottom end of the front connecting piece is pivoted to the arm frame, the bottom end of the rear connecting piece is pivoted to the arm frame.

Compared to the existing known technology, the technical proposal of the present invention has advantages as follows:

1. Before the sofa bed leaves the factory, the arm fames are fixedly connected to the linking mechanism; when assembling, the top end of the front connecting piece is pivoted to the mattress frame, the top end of the rear connecting piece is pivoted to the back frame. The linking mechanism comprises a front connecting piece, rear connecting piece and a bridge connecting piece, the components quantity is fewer, the structure is simple, the cost can be reduced at least 10%, also reduced is the weight.

2. The thickness of the linking mechanism is thin, before the sofa bed leaves the factory, the linking mechanism is fixed to the arm frames, not influencing the integral package. When assembling, the top end of the front connecting piece is pivoted to the mattress frame, the top end of the rear connecting piece is pivoted to the back frame, the assembling steps are fewer, making the assembling conveniently. The screw quantity of the sofa bed is efficiently reduced, further reduced is the cost and the weight. 2.

BRIEF DESCRIPTION OF THE DRAWINGS

The present invention will be further described with the drawings and the embodiments.

DETAILED DESCRIPTION OF THE EMBODIMENTS

Figure 1:
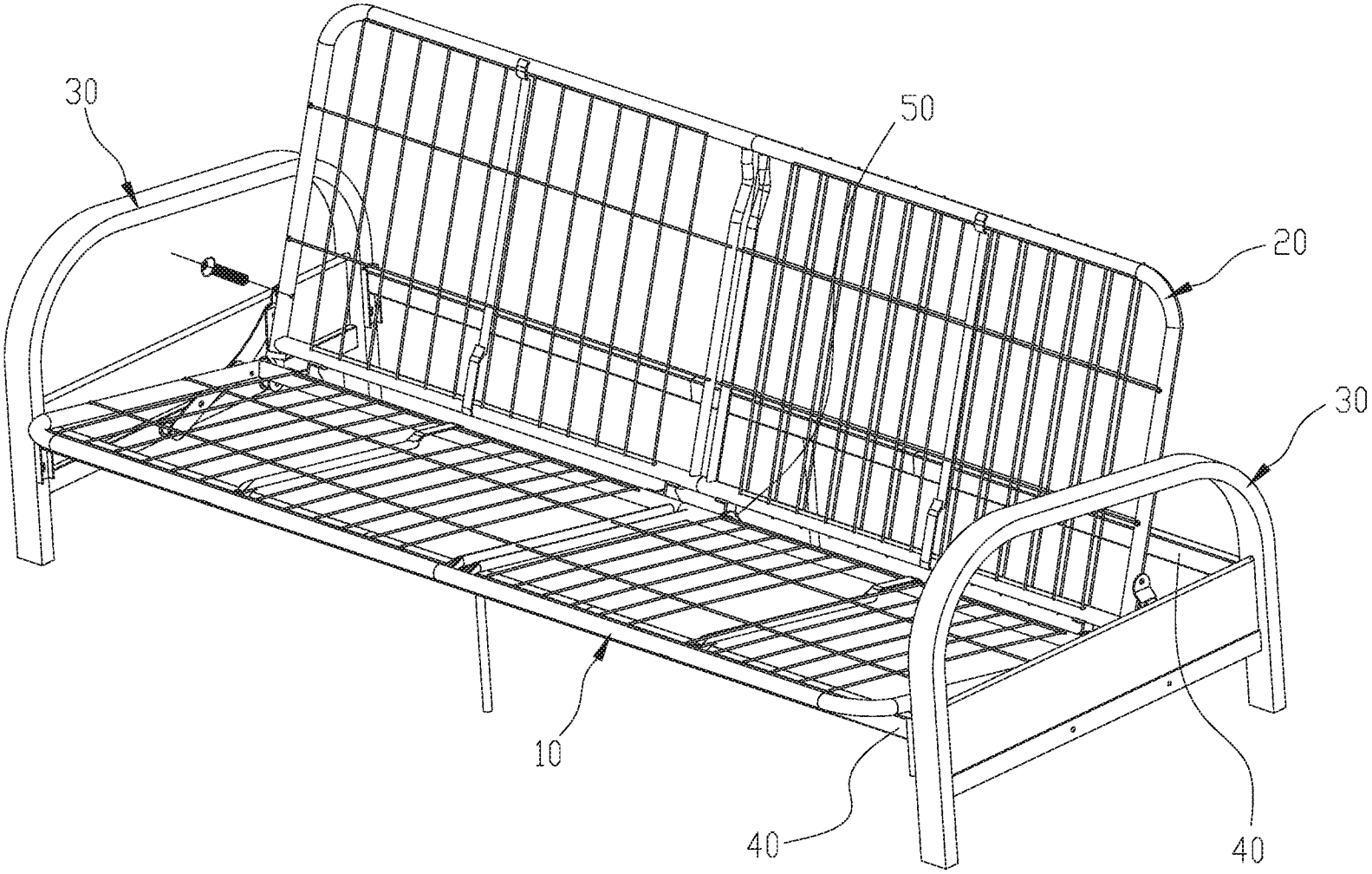
FIG. 1 illustrates a schematic diagram of a new sofa bed of the present invention.
Figure 2:
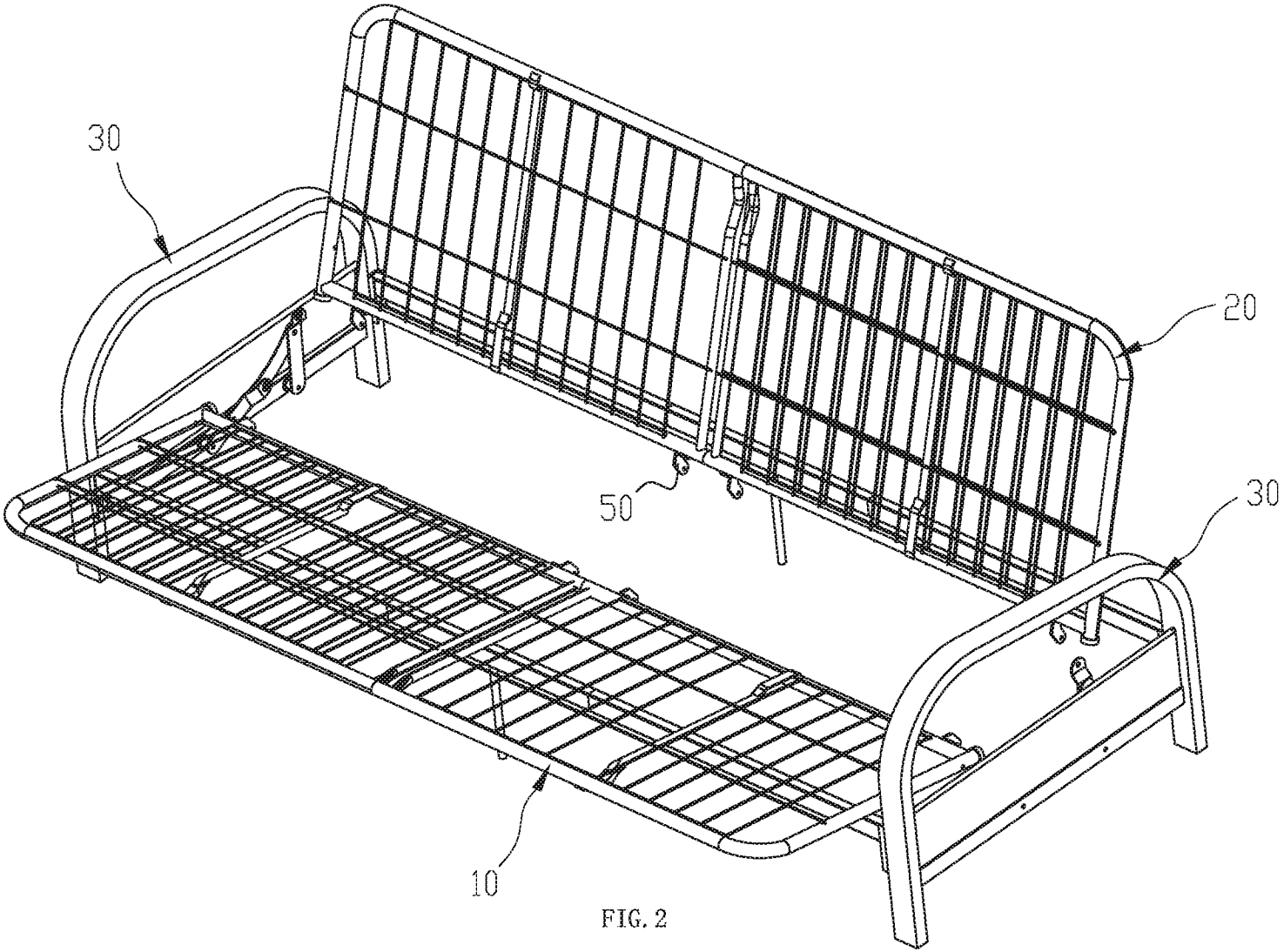
FIG. 2 illustrates a partial exploded and schematic diagram of the new sofa bed of FIG. 1.
Figure 3:
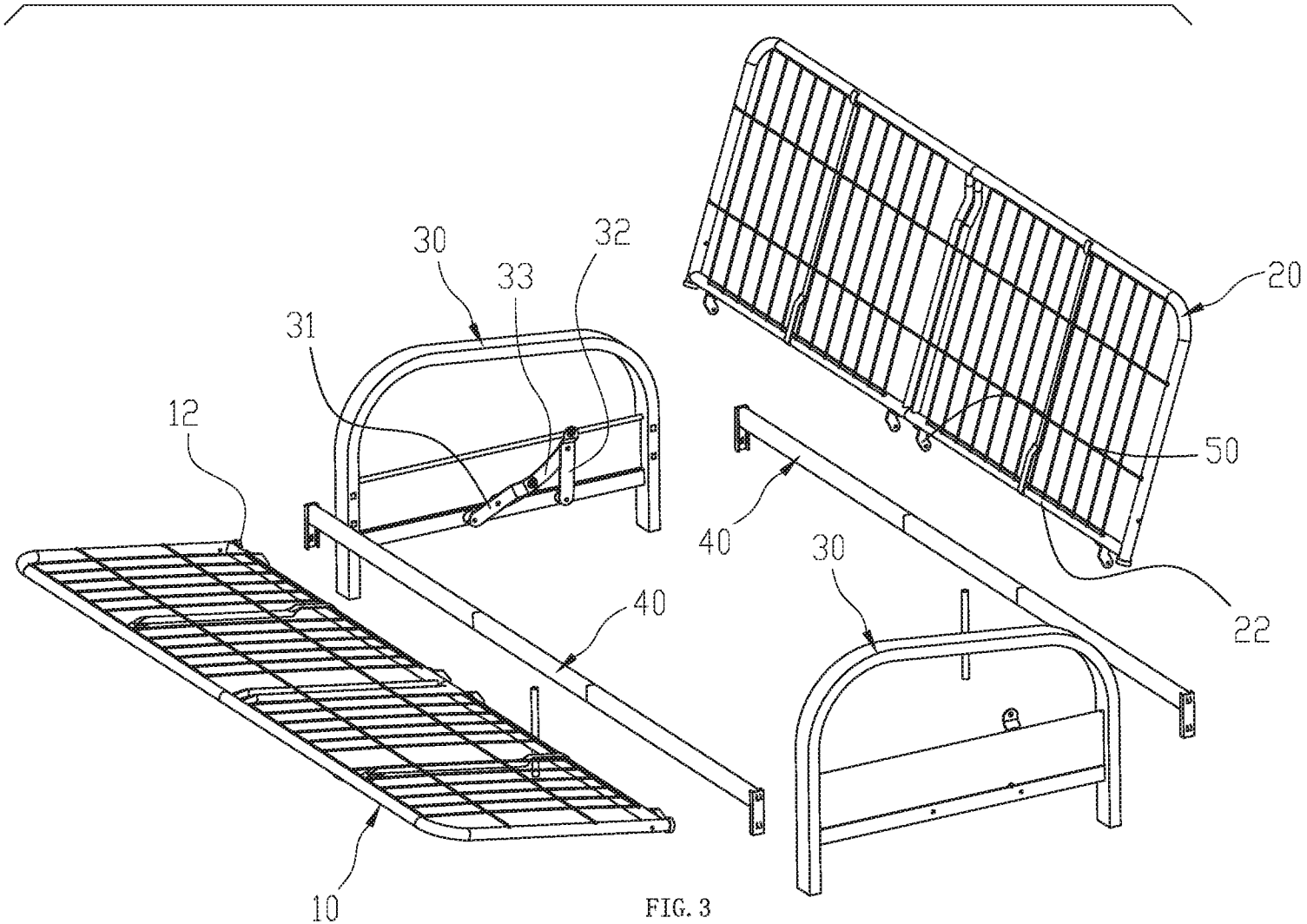
FIG. 3 illustrates an exploded and schematic diagram of the new sofa bed of FIG. 1.
Figure 4:
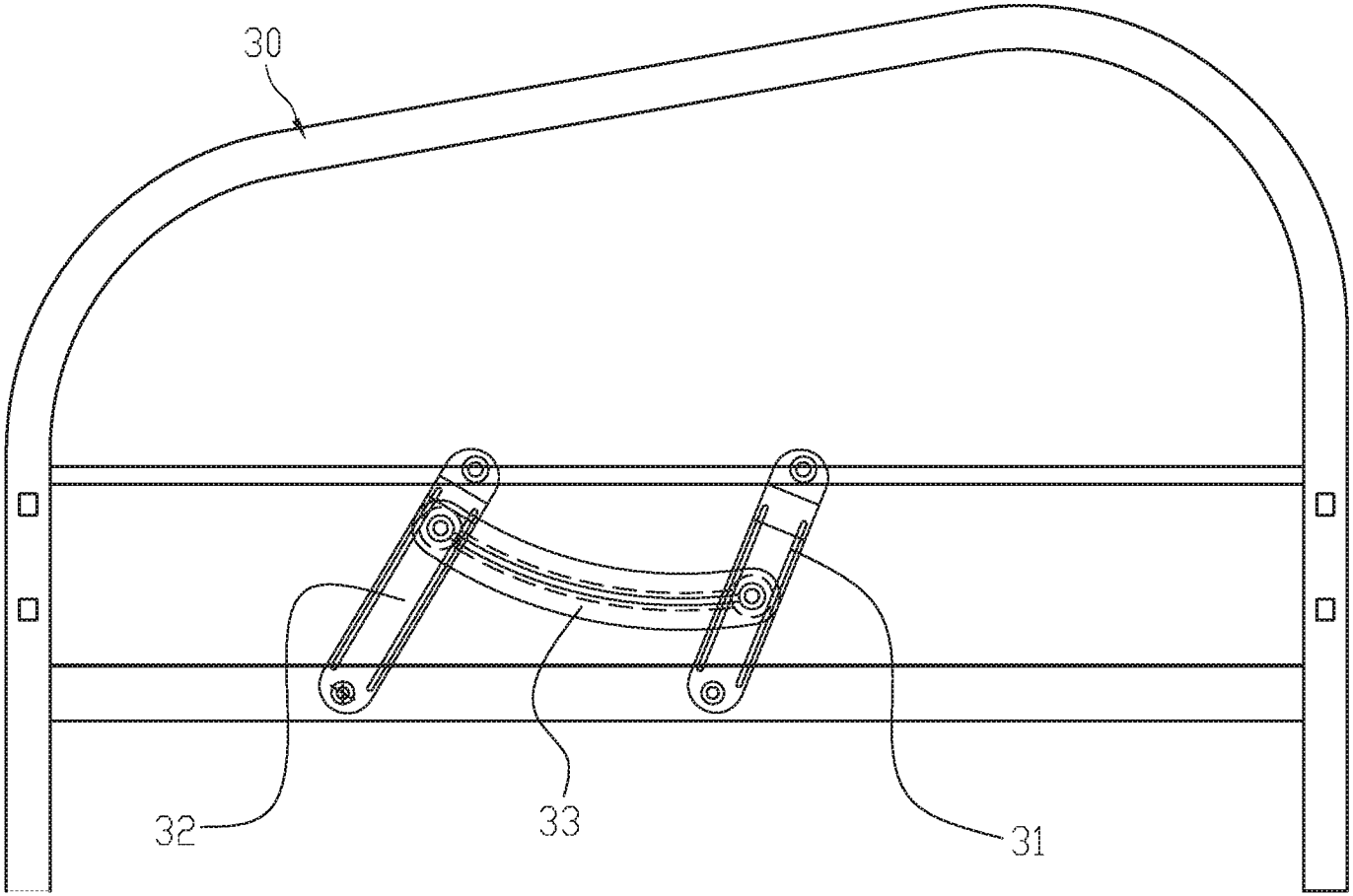
FIG. 4 illustrates a front view of the arm frame of the sofa bed of FIG. 1.
Figure 5:
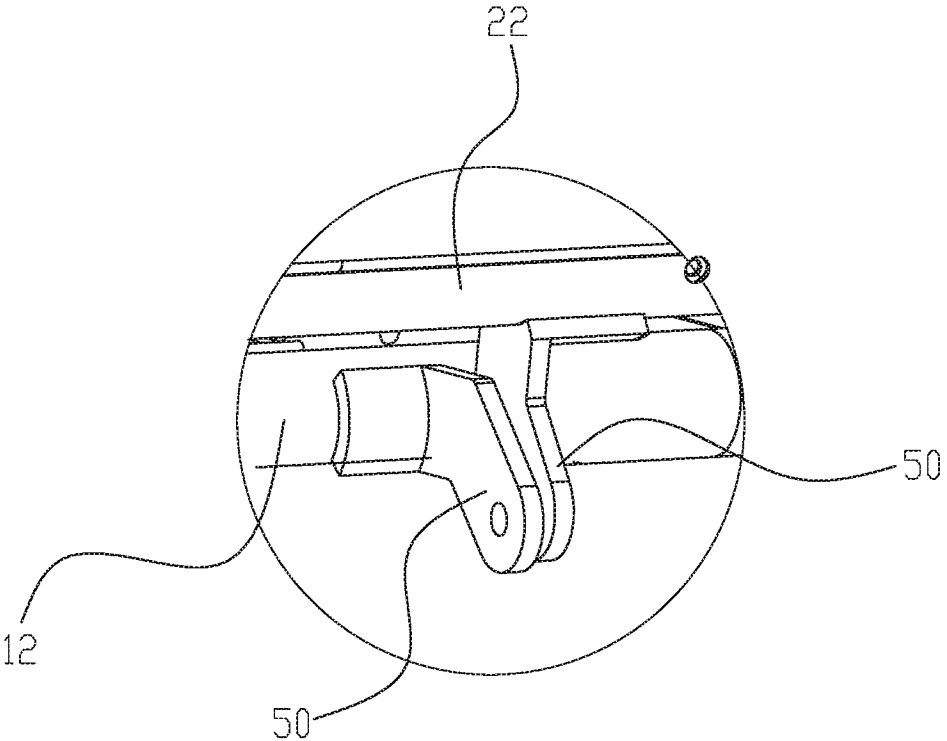
FIG. 5 illustrates a schematic diagram of the rotating hinge of the sofa bed of FIG. 1.

Referring to FIGS. 1-5, the sofa bed of the present invention comprises a mattress frame 10, a back frame 20, two arm frames 30 and two cross beams 40. Two arm frames 30 are connected by the two cross beams 40. The mattress frame 10 and the back frame 20 are rotatably pivoted by at least one pair of rotating hinges 50. The inner side of the arm frame 30 is disposed with a linking mechanism, the linking mechanism comprises a front connecting piece 31, rear connecting piece 32 and a bridge connecting piece 33, two ends of the bridge connecting piece 33 are respectively pivoted to the front connecting piece 31 and the rear connecting piece 32, the bottom end of the front connecting piece 31 is pivoted to the arm frame 30, the bottom end of the rear connecting piece 32 is pivoted to the arm frame 30. Before the sofa bed leaves the factory, the arm fames 30 are fixedly connected to the linking mechanism, therefore, the consumer needn't to assemble the arm frames and the linking mechanism; when assembling, the top end of the front connecting piece 31 is pivoted to the mattress frame 10, the top end of the rear connecting piece 32 is pivoted to the back frame 20. The installation steps are fewer, and the assembling is fast. The mattress frame 10 and the back frame 20 are pivoted by at least a pair of rotating hinges 50. The rotating hinges 50 pull the mattress frame and the back frame at the same time, thus improving the strength of the sofa bed.

connecting piece 31 is riveted to the arm frame 30. The bottom end of the rear connecting piece 32 is riveted to the arm frame 30. It reduces the utility quantity of the bolts by riveting method, thus reducing the cost and the weight.

The top end of the front connecting piece 31 is pivoted to the mattress frame 10 by bolt, the top end of the rear connecting piece 32 is pivoted to the back frame 20 by bolt. The linking mechanism is connected to the mattress frame 10 and the back frame 20 respectively just by a bolt, making the assembly easy. Or in another case, The top end of the front connecting piece 31 is pivoted to the mattress frame 10 by pin, the top end of the rear connecting piece 32 is pivoted to the back frame 20 by pin. And the end portion of the pin is disposed with a clamp spring to prevent the pin from dropping out. Preferred, the top end of the front connecting piece 31 is detachably pivoted to the mattress frame 10, the top end of the rear connecting piece 32 is detachably pivoted to the back frame 20.

Preferred, before the sofa bed leaves the factory, the mattress frame 10 and the back frame 20 are connected to an integral one by the rotating hinge 50. The mattress frame 10 and the back frame rotate relatively, but they do not separate from each other. Therefore, the rigidity of the mattress frame 10 and the back frame 20 is well, and the assembly steps are reduced.

The rotating hinges 50 of each pair are riveted to form an integral one. Or in another case, the rotating hinges 50 of each pair are connected by a bolt to form an integral one.

The rotating hinge is ⟨ shaped. The rotating hinges 50 of each pair are respectively disposed at the cross beam 12 at the inner side of the mattress frame 10 and the cross beam 22 at the inner side of the back frame 20. preferred, the sofa bed comprises four pairs of rotating hinges 50, two of them are respectively near to the two arm frames 20, while the other two are disposed at the central portion of the cross beam; one end of the rotating hinge 50 is fixedly connected to the cross beam.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A sofa bed, comprising a mattress frame, a back frame, a first arm frame, a second arm frame and two cross beams, wherein the first arm frame and the second arm frame are connected by the two cross beams, wherein the mattress frame and the back frame are rotatably pivoted by at least a pair of rotating hinges, a first rotating hinge of the pair of rotating hinges is disposed on a cross beam at an inner side of the mattress frame and a second rotating hinge of the pair of rotating hinges is disposed on a cross beam at an inner side of the back frame, an inner side of the first arm frame or the second arm frame is respectively disposed with a linking mechanism, each of the linking mechanisms respectively comprises a front connecting piece, a rear connecting piece and a bridge connecting piece, wherein in the each of the linking mechanisms, a first end of the bridge connecting piece is pivotable relative to the front connecting piece and a second end of the bridge connecting piece is pivotable relative to the rear connecting piece, a bottom end of the front connecting piece is pivotable relative to the first arm frame or the second arm frame, a bottom end of the rear connecting piece is pivotable relative to the first arm frame or the second arm frame, a top end of the front connecting piece is pivotable relative to the mattress frame, and a top end of the rear connecting piece is pivotable relative to the back frame.

2. The sofa bed according to claim 1, wherein the bottom end of the front connecting piece is riveted to the first arm frame or the second arm frame, and the bottom end of the rear connecting piece is riveted to the first arm frame or the second arm frame.

3. The sofa bed according to claim 2, wherein the top end of the front connecting piece is pivotable relative to the mattress frame by a first pin or a first bolt, and the top end of the rear connecting piece is pivotable relative to the back frame by a second pin or a second bolt.

4. The sofa bed according to claim 3, wherein at least one of an end portion of the first pin is disposed with a first clamp spring or an end portion of the second pin is disposed with a second clamp spring.

5. The sofa bed according to claim 1, wherein the cross beam at the inner side of the mattress frame and the cross beam at the inner side of the back frame extend between the first arm frame and a second arm frame of the two arm frames.

6. The sofa bed according to claim 1, wherein the mattress frame and the back frame are connected by the pair of rotating hinges.

7. The sofa bed according to claim 6, wherein the first rotating hinge is riveted to the second rotating hinge.

8. The sofa bed according to claim 6, wherein the first rotating hinge is connected to the second rotating hinge by a bolt.

9. The sofa bed according to claim 6, wherein the pair of rotating hinges in combination is ⟨ shaped.

10. The sofa bed according to claim 1, wherein the top end of the front connecting piece is pivotable relative to the mattress frame by a first pin or a first bolt, and the top end of the rear connecting piece is pivotable relative to the back frame by a second pin or a second bolt.

11. The sofa bed according to claim 10, wherein at least one of an end portion of the first pin is disposed with a first clamp spring or an end portion of the second pin is disposed with a second clamp spring.

* * * * *